US006796815B2

(12) United States Patent
Okabe et al.

(10) Patent No.: US 6,796,815 B2
(45) Date of Patent: Sep. 28, 2004

(54) LEVER FITTING TYPE CONNECTOR

(75) Inventors: Toshiaki Okabe, Shizuoka-ken (JP); Tetsuya Yamashita, Shizuoka-ken (JP); Masaru Fukuda, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/099,996

(22) Filed: Mar. 19, 2002

(65) Prior Publication Data

US 2002/0137377 A1 Sep. 26, 2002

(30) Foreign Application Priority Data

Mar. 22, 2001 (JP) ..... P 2001-082774

(51) Int. Cl.[7] ..... H01R 13/62

(52) U.S. Cl. ..... 439/157; 439/247; 439/347; 439/545

(58) Field of Search ..... 439/157, 247, 439/341–343, 347, 545

(56) References Cited

U.S. PATENT DOCUMENTS

| | | | | |
|---|---|---|---|---|
| 5,839,912 | A | * 11/1998 | Schekalla et al. | 439/157 |
| 5,902,141 | A | * 5/1999 | Iwahori | 439/157 |
| 5,980,283 | A | * 11/1999 | Okabe | 439/157 |
| 6,086,392 | A | * 7/2000 | Okabe | 439/157 |
| 6,139,335 | A | 10/2000 | Kodama | |
| 6,183,282 | B1 | 2/2001 | Okabe | |
| 6,309,232 | B1 | * 10/2001 | Okabe et al. | 439/157 |
| 6,312,273 | B1 | * 11/2001 | Hasegawa et al. | 439/157 |
| 6,361,356 | B1 | * 3/2002 | Heberlein et al. | 439/489 |

FOREIGN PATENT DOCUMENTS

| | | |
|---|---|---|
| DE | 199 36 871 A1 | 3/2000 |
| DE | 199 44 085 A1 | 8/2000 |
| EP | 1 083 637 A1 | 3/2001 |
| GB | 2 289 171 A | 11/1995 |
| JP | 4-67582 | 3/1992 |

OTHER PUBLICATIONS

English language translation of the Office Action issued by the German Patent and Trademark Office on Apr. 23, 2004.

* cited by examiner

*Primary Examiner*—Truc Nguyen
(74) *Attorney, Agent, or Firm*—Finnegan, Henderson, Farabow, Garrett & Dunner, L.L.P.

(57) ABSTRACT

A lever fitting type connector (10) includes both connectors (20, 30) fitted to each other, and a lever (40) interposed between both of the connectors (20, 30) and converting an operation force applied to an operation portion (43) into a fitting force between both of the connectors (20, 30). In the lever fitting type connector (10), the lever (40) is rotatably pivoted on the first connector (20), and an engagement portion (60) engaged with the lever (40) is provided on the second connector (30). A standing mechanism (50) is provided between the lever (40) and the second connector (30). The standing mechanism (50) has a function that stands the lever (40) when temporarily fitting both of the connectors (20, 30). An amount of rotation of the lever (40) is secured largely by applying the operation force to the operation portion (43) in a standing state of the lever (40), so as to regularly fit both of the connectors (20, 30).

17 Claims, 10 Drawing Sheets

PRIOR ART

PRIOR ART

LEVER FITTING TYPE CONNECTOR

BACKGROUND OF THE INVENTION

1. Field of the Invention

The present invention relates to a lever fitting type connector structured such as to rotate a lever interposed between both of the connectors fitted to each other, so as to convert a lever operating force into a fitting force between both of the connectors.

2. Description of the Related Art

As a lever fitting type connector, there has been proposed a structure shown in FIGS. 1 to 3. As shown in FIG. 1 and FIG. 2, a lever fitting type connector 1 is generally constituted by a female connector 2 mounted to a side of equipment or the like, a male connector 3 to which a wire harness (not shown) is connected, and a lever 4 interposed between the female connector 2 and the male connector 3. A plurality of terminal receiving chambers 3*a* is formed in the male connector 3. A terminal (not shown), which is connected to an edge of each of electric wires of the wire harness, is received in each of the terminal receiving chambers 3*a*.

As shown in FIG. 1 and FIG. 2, the lever 4 is arranged astride both upper and lower sides of the male connector 3. The lever 4 is pivoted in a rotating manner and connected to a cylindrical boss portion 3*b* protruding from the male connector 3, and the male connector 3 and the lever 4 to which are connected are temporarily fitted within the female connector 2.

In the temporarily fitting state mentioned above, by pressing an operation portion 4*a* of the lever 4, the lever 4 rotates around an engagement projection 4*b* engaged with the female connector 2, the engagement projection forming a point of support. Accordingly, the boss portion 3*b* forms a point of application, and presses the male connector 3 into the female connector 2, so as to regularly fit. An operation force of the operation portion 4*a* can be converted into the fitting force of the male connector 3.

However, in the proposed lever fitting type connector 1, a fitting force is generated in the lever 4 by applying the operation force in a pressing direction to the operation portion 4*a*. Further, at an initial mounting position (refer to FIG. 1) of the lever 4 in a state in which the male connector 3 and the female connector 2 are separated from each other, in order to secure a pressing amount of the operation portion 4*a*, the operation portion 4*a* is mounted so that the operation portion 4*a* protrudes a distance L outward from the male connector 3 (refer to FIG. 2). Hence, the lever 4 connected to the male connector 3 is protruded, whereby the male connector 3 is wholly made large. In particular, at a time of connecting the lever fitting type connector 1 as a part of the wire harness connected to a lot of electrical parts in a vehicle or the like, the male connector 3 constituting a portion connecting to the wire harness is made large. Accordingly, an opening area of a gap for passing the male connector 3 becomes large. That is, a great space for passing the enlarged male connector 3 is required in a passage for arranging the wire harness.

Accordingly, it is necessary to intend to reduce a protruding amount of the lever 4 so as to make a whole of the male connector 3 compact. However, an amount of rotational operation of the lever 4 becomes necessarily small. Therefore, a servo assisting effect applied to the point of application in the lever 4 is reduced, and a sufficient fitting force can not be obtained.

In the lever fitting type connector 1, a mounting direction of the lever 4 is previously fixed to a constant direction. Hence, a direction of taking out the wire harness connected to the male connector 3 is determined by a direction of arranging the operation portion 4*a* of the lever 4. Therefore, a great restriction is applied to a direction of the lever fitting type connector 1, and a freedom of the wire harness in a connecting direction is reduced. Further, the restriction of the wire harness in a connecting direction is given in requirement of vehicle such as a right-handle drive, a left-handle drive or the like.

In the lever fitting type connector 1 mentioned above, the structure of the lever fitting type connector 1 is made such that the lever 4 is fitted to an outer side of the male connector 3 and is fitted to the female connector 2 in this fitting state. Further, there is required a space for engaging the engagement projection 4*b* of the lever 4 with the female connector 2. That is, as shown in FIG. 3, a whole thickness of the lever fitting type connector 1 is determined by a summation of a thickness a of the male connector 3, a thickness b of the lever 4, an engaging (protruding) space c of the engagement projection 4*b*, and a substantial thickness d of the female connector 2. As a result, a whole thickness of the lever fitting type connector 1 is increased. As mentioned above, the lever fitting type connector 1 is made thick, so that the lever fitting type connector 1 makes large. Accordingly, a large space is also required in the passage of arranging the wire harness.

SUMMARY OF THE INVENTION

First object of the present invention is to intend to make a whole structure of the connector compact while sufficiently securing an amount of rotational operation of a lever. Second object of the present invention is to freely change a mounting direction of the lever in a width direction. Third object of the present invention is to make a whole thickness of the connector small, so as to intend to make the structure of the connector further compact.

The first aspect of the present invention provides a lever fitting type connector comprising: a first connector; a second connector fitted to the first connector; and a lever interposed between the first connector and the second connector, and converting an operation force applied to an operation portion into a fitting force between the first connector and the second connector, wherein the lever is rotatably pivoted on the first connector, and an engagement portion engaging with the lever is provided on the second connector, wherein a standing mechanism is provided between the lever and the second connector, and the standing mechanism stands the lever when temporarily fitting the first connector to the second connector, wherein the first connector and the second connector are regularly fixed to each other by applying an operation force to the operation portion in a standing state of the lever.

In this lever fitting type connector, by temporarily fitting to both of the connectors, the lever rotatably pivoted on the first connector is stood up by the standing mechanism. Due to the standing-up of the lever, it is possible to secure a sufficient amount of rotational operation in the lever. It is possible to sufficiently obtain a servo assisting function applied by the lever, so as to easily and securely execute a regular fitting to between both of the connectors. Accordingly, in a state before temporarily fitting to both of the connectors, that is, in a state in which the first connector and the second connector are separated, it is possible to mount the lever on the first connector, so as not to protrude from the first connector. Accordingly, it is possible to make the connector compact as a whole in a state that the lever is mounted on the first connector. Further, it is possible to make the space for arranging the wire harness connected to the connector small.

The second aspect of the present invention provides a lever fitting type connector comprising: a first connector having a hood portion; a second connector fitted within the hood portion of the first connector; and a lever interposed between the first connector and the second connector, and converting an operation force applied to an operation portion into a fitting force between the first connector and the second connector, wherein the lever is outward fitted to the hood portion and detachably pivoted on the first connector, and an a plurality of engagement portions provided in the second connector are engaged with the lever, and a groove portion formed in the hood portion escapes the engagement portion, and wherein the engagement portions and the groove portion are substantially symmetrical about a supporting engagement portion in a width direction.

In this lever fitting type connector, the engagement portion is engaged with the lever, and the groove portion escapes the engagement portion. The engagement portion and the groove portion are respectively formed substantially and symmetrically in the width direction around the supporting engagement portion. According to the structure, even in the case that the lever, which is pivoted in a detaching manner to the first connector in the outward fitting state, is pivoted in a state of reversing in the width direction of the first connector, it is possible to secure an inherent function executed between the lever and the engagement portion. Therefore, it is possible to optionally reverse the mounting direction of the lever in correspondence to the direction of taking out the wire harness connected to the first connector. Accordingly, it is possible to increase a freedom of a direction of connecting the wire harness to the connector.

The third aspect of the present invention provides a lever fitting type connector comprising: a first connector having a hood portion; a second connector fitted within the hood portion of the first connector; and a lever interposed between the first connector and the second connector, and converted an operation force applied to an operation portion into a fitting force between the first connector and the second connector, wherein the lever is outward fitted and detachably pivoted on the second connector, a plurality of engagement portions are provided in the hood portion of the first connector, and the engagement portions are symmetrical about a supporting engagement portion in a width direction.

The fourth aspect of the present invention provides a lever fitting type connector comprising: a first connector; a second connector fitted to the first connector; and a lever interposed between the first connector and the second connector, and converting an operation force applied to an operation portion into a fitting force between the first connector and the second connector, wherein in a state of outward fitting the lever to the first connector, a thickness of an engagement portion, which is provided in the second connector and engaged with the lever, is set to be thinner than a thickness of the first connector.

According to this lever fitting type connector, the lever is arranged in an outer side of the first connector. However, since the engagement portion engaged with the lever can be provided within the thickness of the first connector, a thickness of a whole of the lever fitting type connector can be constituted by three thickness elements comprising a thickness of the second connector, a thickness of the first connector and a thickness of the lever. Accordingly, a protruding amount of the engagement portion does not affect. Therefore, it is possible to make the thickness of a whole of the lever fitting type connector small so as to make the structure compact. Accordingly, it is possible to make the space for passing the wire harness therethrough small at a time of arranging the wire harness.

The fifth aspect of the present invention provides a lever fitting type connector according to the first aspect of the present invention, wherein the standing mechanism comprising: a first engagement portion provided on the lever; and a second engagement portion provided on the second connector and engaged with the first engagement portion, wherein the standing mechanism is constituted such that the first connector is fitted to the second connector, so that the first connector is engaged with the second engagement portion, and wherein the first connector is further fitted to the second connector, so that the lever rotates and stands up about a pivot portion.

BRIEF DESCRIPTION OF THE DRAWINGS

The invention will now be described with reference to the accompanying drawings wherein.

DETAILED DESCRIPTION OF THE PREFERRED EMBODIMENTS

Figure 1:
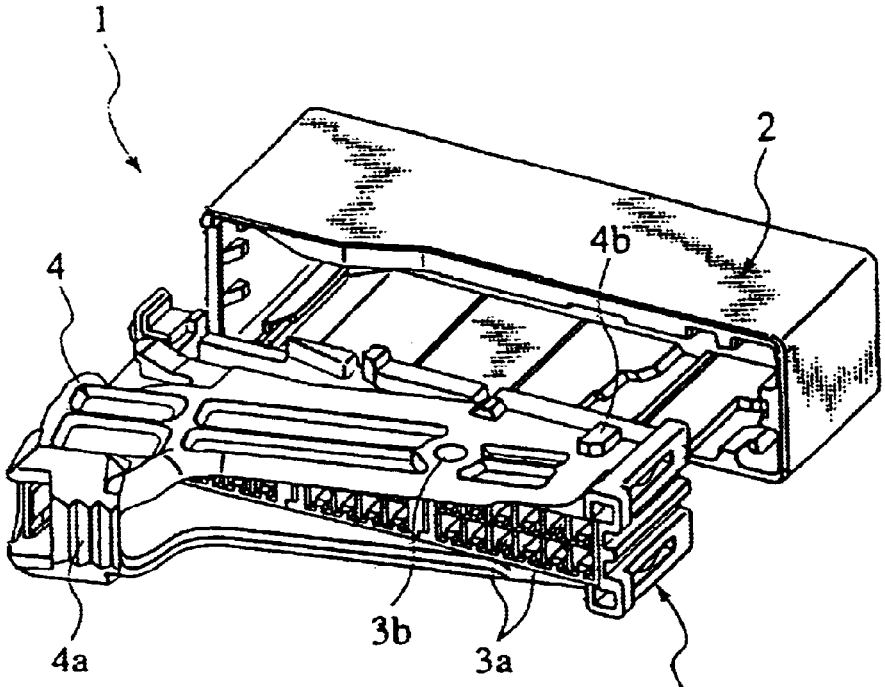
FIG. 1 shows a perspective view a state of separating female and male connectors in a proposed lever fitting type connector.
Figure 2:
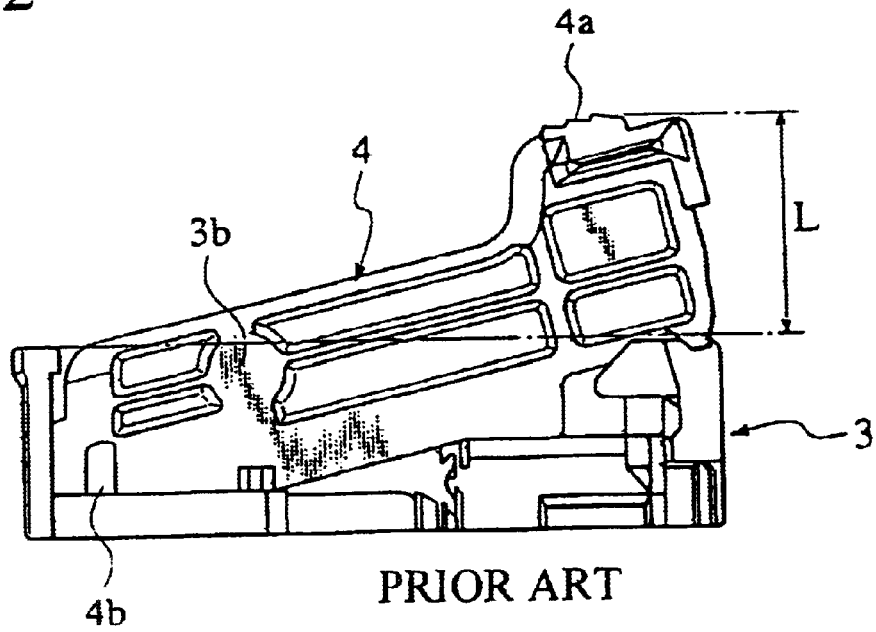
PRIOR ART FIG.2
FIG. 2 shows a plan view of a state in which a lever is mounted to the male connector in the proposed lever fitting type connector.
Figure 3:
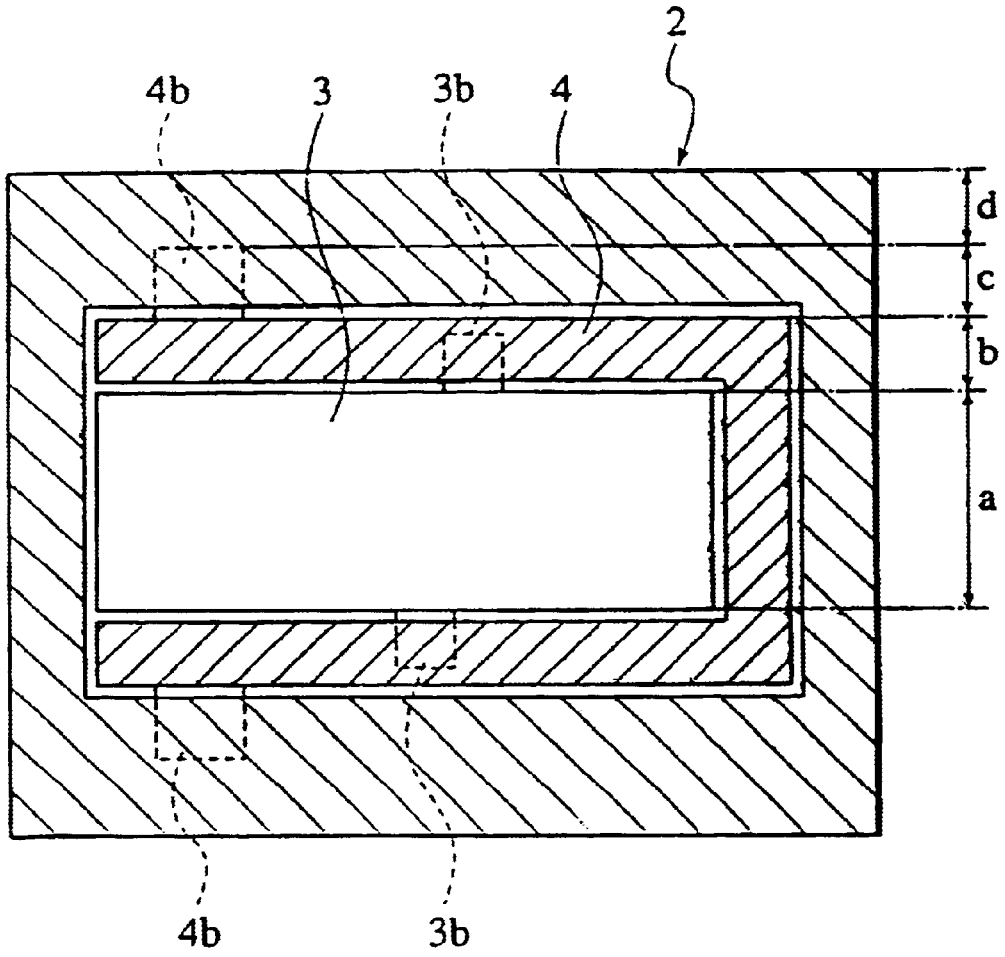
FIG. 3 shows a schematically cross sectional view describing a structure in a thickness direction of the proposed lever fitting type connector.

Embodiments of the present invention will be explained below with reference to the drawings, wherein like numbers are designated by like reference characters.

Figure 4:
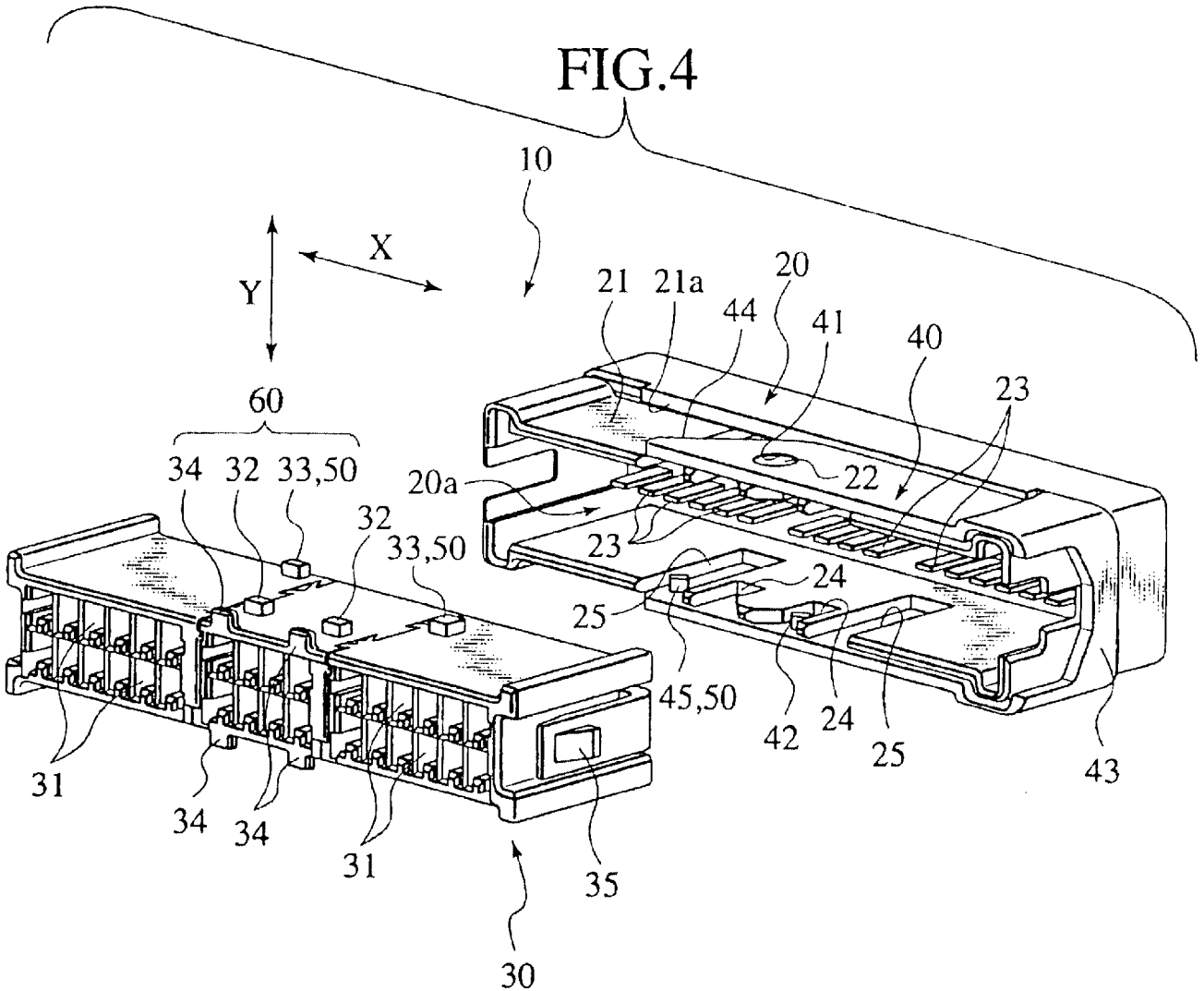
FIG. 4 shows a perspective view of a state in which the female and male connectors are separated, showing an embodiment of a lever fitting type connector according to the present invention.
Figure 5:
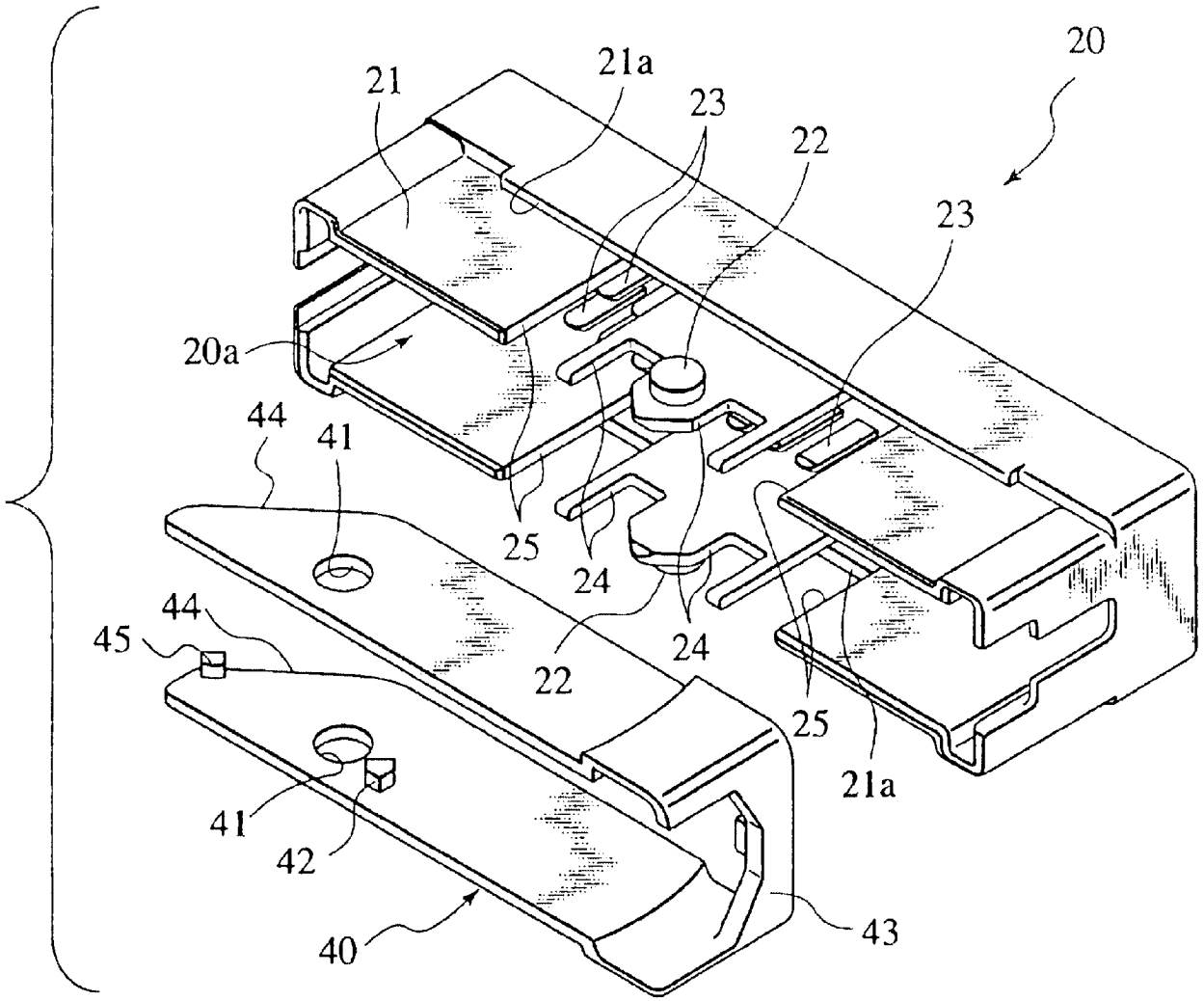
FIG. 5 shows a perspective view of a state in which the female connector and the lever are separated, showing an embodiment of a lever fitting type connector according to the present invention.

As shown in FIG. 4, a lever fitting type connector 10 is generally constituted by a synthetic resin female connector 20 corresponding to one of connectors fitted to each other, a synthetic resin male connector 30 corresponding to another connector, and a lever 40 interposed between the female connector 20 and the male connector 30. The lever 40 is provided with a center hole 41 forming a fulcrum of rotation, an application projection 42 forming a point of application and an operation portion 43 forming a point of force.

Figure 6:
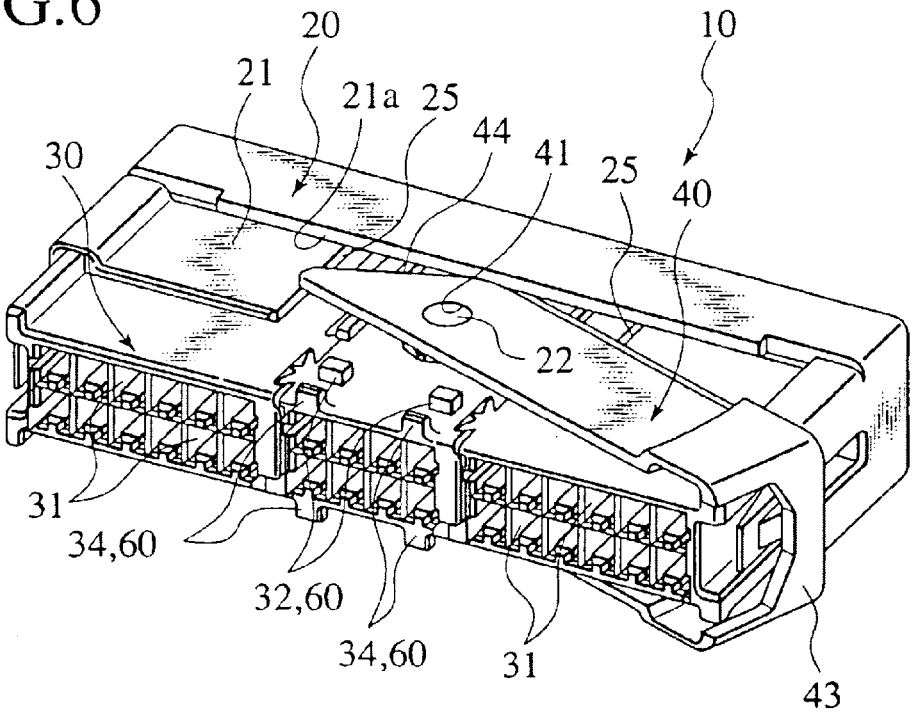
FIG. 6 shows a perspective view of an early stage of temporarily fitting, showing an embodiment of a lever fitting type connector according to the present invention.

As shown in FIG. 4 and FIG. 6, the female connector 20 is structured such that a hood portion 21 provided in a front side thereof is formed as a rectangular hollow case. A front surface of the female connector 20 is formed as a frontage 20*a* for fitting to the male connector 30, so as to be opened. The hood portion 21 has a step portion 21*a* in the connector main body (the connector housing) of the female connector 20. Further, the hood portion 21 has a slightly thinned shape and is integrally protruded from the connector main body.

In the all below description, an X direction shown in FIG. 4 is employed as a width direction. Further, an Y direction is employed as a thickness direction corresponding to a direction perpendicular to the width direction X.

A cylindrical supporting engagement portion 22 detachably fitting to the center hole 41 of the lever 40 is protruded in a center portion of the hood portion 21 in the width direction X.

The lever 40 is mounted while detachably fitting the center hole 41 to the supporting engagement portion 22 of the hood portion 21. The lever 40 is formed in a substantially U shape. Both bent end portions of the lever 40 are respectively formed symmetrically in the opposing direction (thickness direction) Y. The lever 40 formed in the U shape with the symmetrical shape is structured such that the operation portion 43 is formed as a bent portion in the lever 40. Further, the center holes 41 are respectively formed in both end portions close to front-end portions thereof. Further, the applicating projections 42 are respectively protruded in inner sides between the operation portion 43 and the respective center holes 41.

The lever 40 is fitted astride both upper and lower wall surfaces in the thickness direction Y of the female connector 20, and is initially mounted so as to receive the lever 40 in an outer side of the hood portion 21 while fitting the center holes 41 to the supporting engagement portions 22. When the lever 40 is at an initially mounting position (refer to FIG. 4), the lever 40 is completely received in the hood portion 21 and is arranged in parallel to the width direction X of the female connector 20. At this initially mounting position, the operation portion 43 of the lever 40 is arranged so as to cover one outer side with respect to the width direction X of the frontage 20*a*. Further, inclined portions (taper portions) 44 are formed in front end portions at both ends of the lever 40, thereby preventing a front end corner portion from being interfered with the step portion 21*a* of the hood portion 21 when the lever 40 stands up.

Accordingly, being formed symmetrically as mentioned above, as shown in FIGS. 13A and 13B, even in the case of mounting the lever 40 laterally and reversibly, it is possible to outward fit to the hood portion 21 of the female connector 20 while fitting the center hole 41 to the supporting engagement portion 22. That is, the lever 40 is reversibly located in a reverse side with respect to the width direction of the female connector 20.

As shown in FIG. 4, the male connector 30 is formed in a rectangular parallelepiped shape, which is substantially closely fitted to an inner side of the hood portion 21 in the female connector 20. A plurality of terminal receiving chambers 31 accommodate female edges (not shown) connected to terminals of respective electric wires H constituting a wire harness W/H. The terminal receiving chambers 31 are formed in an inner portion thereof rightward and leftward so as to construct upper and lower stages.

As shown in FIG. 4, a plurality of male terminals 23 are protruded in a back side of the inner portion in the female connector 20 in correspondence to the respective terminal receiving chambers 31. In a state that the female connector 20 and the male connector 30 are regularly fitted, a female terminal of the male connector 30 is connected to the male terminal 23 of the female connector 20.

In the present embodiment, inserting engagement portions 32 engaged with the applicating projection 42 are protruded on both outer wall surfaces in the thickness direction (vertical direction) Y of the male connector 30. Therefore, an operation force, which is applied to the operation portion 43 of the lever 40, is converted into a fitting force. A standing mechanism 50 stands the lever 40 at a time of temporarily fitting the female connector 20 and the male connector 30. Further, the standing mechanism 50 is provided between the lever 40 and the male connector 30 (refer to FIGS. 7 and 11).

Figure 11:
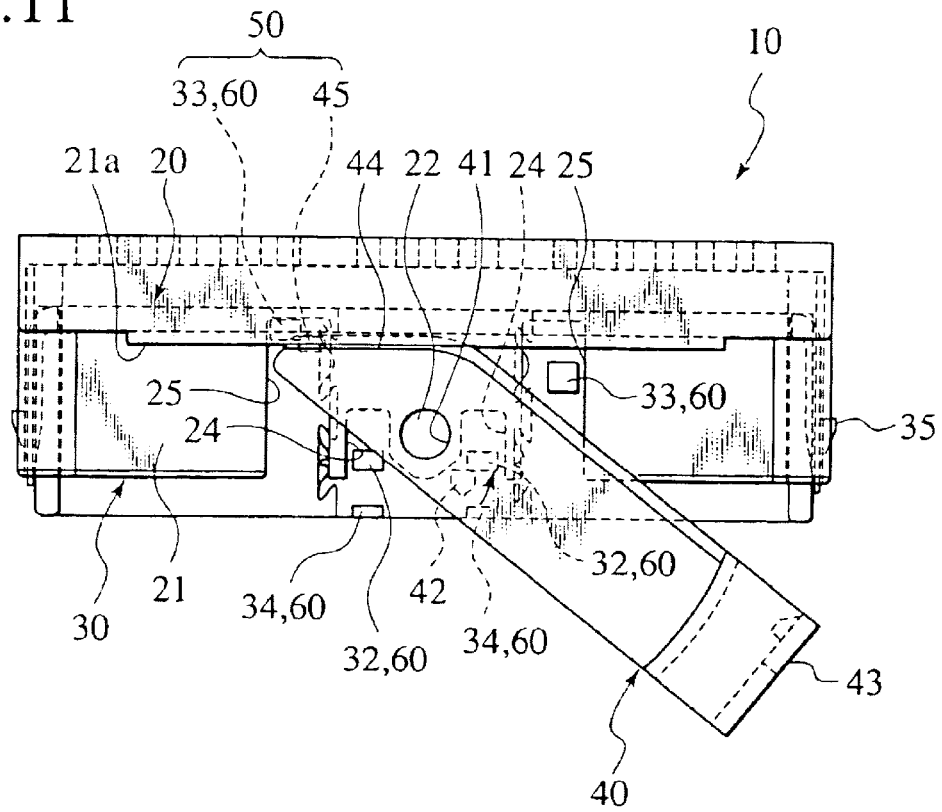
FIG. 11 shows a plan view of a temporarily fitting state, showing an embodiment of a lever fitting type connector according to the present invention.

As shown in FIG. 11, when the lever 40 is in the standing-up state by temporarily fitting the female connector 20 to the male connector 30, the inserting engagement portion 32 engages with the applicating projection 42 of the lever 40 in the backside. Hence, relative positions of the applicating projection 42 and the inserting engagement portion 32 are determined.

As shown in FIG. 4, the standing mechanism 50 includes first standing projections 45 protruded in inner sides of the respective front end portions in both ends of the lever 40, and a pair of second standing projections 33 and 33 protruded on both outer wall surfaces in the thickness direction Y of the male connector 30. The first standing projection 45 is biase formed in an opposing side (in a front side in the drawing) of the lever 40 to the male connector 30, the second standing projections 33 is biase formed in an opposing side (in a far side in the drawing) of the male connector 30 to the female connector 20. The first and second standing projections 45 and 33 are engaged in an early fitting stage of the female and male connectors 20 and 30.

A removing engagement portion 34 is protruded on the wall surface of the male connector 30 in which the inserting engagement portion 32 is protruded. It engages with the applicating projection 42 in a direction of removing the female connector 20 from the male connector 30 when the lever 40 is in a regularly fitting state between the female connector 20 and the male connector 30. The removing engagement portion 34 is located substantially in an opposite side to the inserting engagement portion 32 on the boundary of the applicating projection 42 of the lever 40 at a time when the female connector 20 and the male connector 30 are in the regularly fitting state.

The inserting engagement portion 32, the second standing projection 33 and the removing engagement portion 34 constitute an engagement portion 60 engaged with the lever 40. In accordance with the reversible arrange of the lever 40, the engagement portion 60 is respectively formed substantially and symmetrically on the boundary of the center portion in the width direction X. Further, the engagement portion 60 corresponds to the supporting engagement portion 22 of the male connector 30. In this case, the engagement portion 60 can be constituted by at least one of the inserting engagement portion 32, the second standing projection 33 and the removing engagement portion 34. Further, the other projections can be included as occasion demands.

The inserting engagement portion 32, the second standing projection 33 and the removing engagement portion 34 are formed by being protruded from both of upper and lower wall surfaces of the male connector 30. Further, the applicating projection 42 and the first standing projection 45 are respectively protruded from opposing inner surfaces of the lever 40. The applicating projection 42, the inserting engagement portion 32 engaged with applicating projection 42, the removing engagement portion 34 and the first standing projections 45 and the second standing projections 33 are protruded within the range of a thickness of the hood portion 21.

A first groove portion 24, which escapes the applicating projection 42 when fitting the female and male connectors 20 and 30, is formed in the hood portion 21. Further, a second groove portion 25 escaping the first standing projection 45 is formed in the hood portion 21. The first and second groove portions 24 and 25 are formed in a space that can sufficiently allow a motion of the applicating projection 42 and the first standing projection 45 accompanying with the rotation of the lever 40. First and second groove portions 24 and 25 are open to the opposite side to the male connector 30. When fitting the female connector 20 to the male connector 30, it is possible to introduce the inserting engagement portion 32 and the removing engagement portion 34 within the first groove portion 24. Further, it is possible to introduce the second standing projection 33 within the second groove portion 25.

Figure 13A:
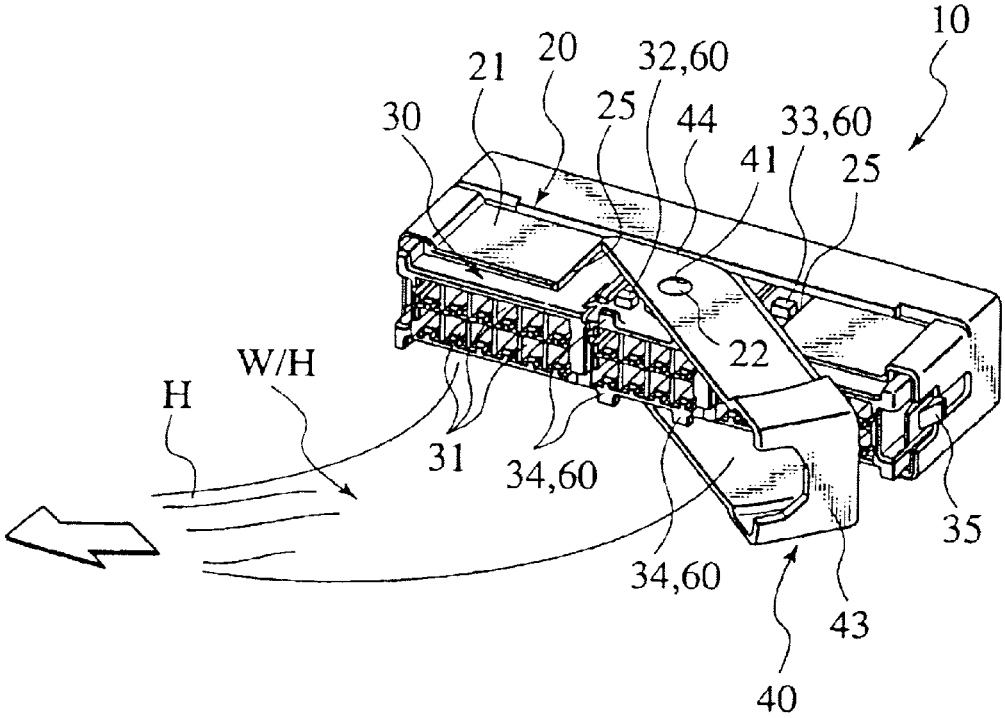
FIGS. 13A and 13B show perspective views respectively describing states in which a mounting direction of the lever is reversed, showing an embodiment of a lever fitting type connector according to the present invention.

Regarding the first and second groove portions 24 and 25, since the lever 40 can be disposed reversibly, the first and second groove portions 24 and 25 are formed to be generally symmetrical to the central portion in the widthwise direction X of the male connector 30. Therefore, in the lever fitting type connector 10, for example, the back face side of the female connector 20 is mounted to an equipment or the like. Further, the male connector 30 having a wire harness W/H connected to its back face side, can be fitted to the female connector 20 and the lever 40 applying a small operating force, as shown in FIG. 13A.

A description of a procedure of fitting the female connectors 20 and the male connectors 30 of the lever fitting type connector 10 will be given below.

Figure 9:
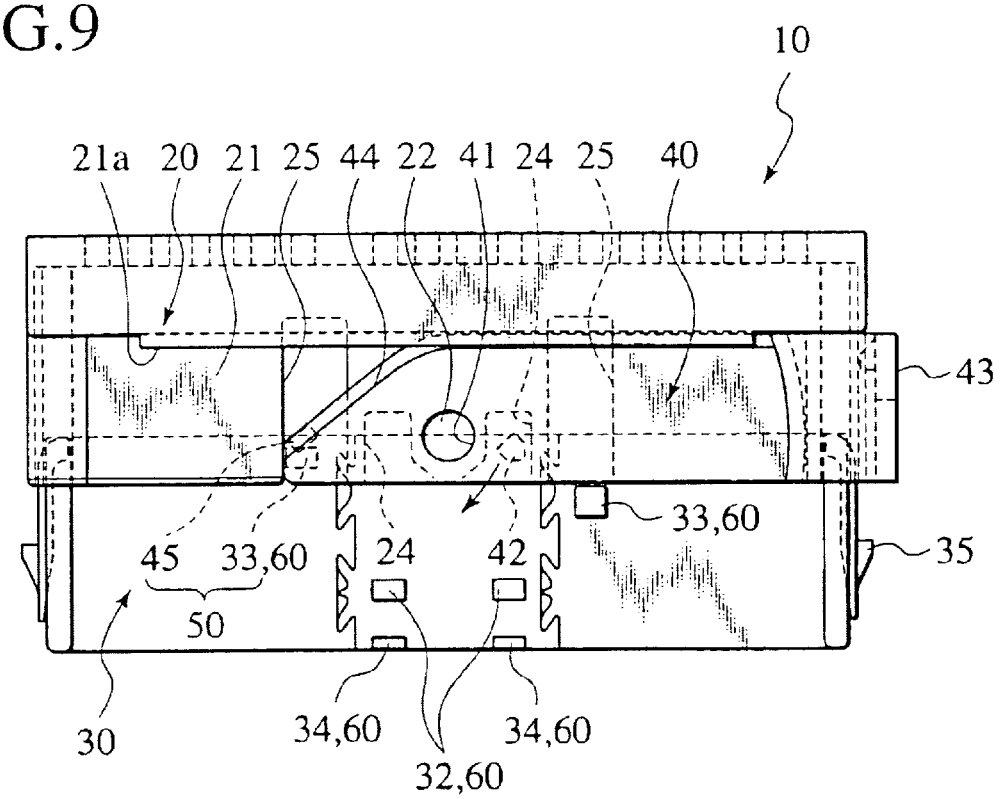
FIG. 9 shows a perspective view of a state before starting a fitting operation, showing an embodiment of a lever fitting type connector according to the present invention.
Figure 10:
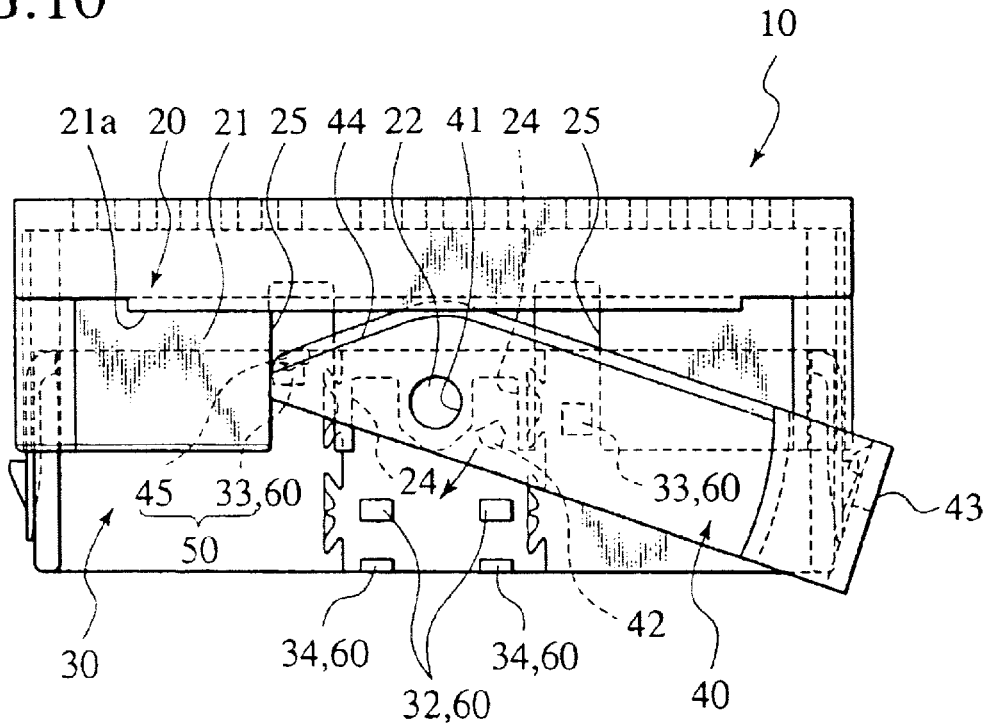
FIG. 10 shows a plan view of an early stage of temporarily fitting, showing an embodiment of a lever fitting type connector according to the present invention.

As shown in FIG. 4, before fitting the female and male connectors 20 and 30 to each other, the lever 40 initially mounted to the female connector 20 becomes in parallel to the width direction X of the frontage 20*a*. In this state, as shown in FIG. 9, the male connector 30 is inserted to the hood portion 21 of the female connector 20. Then, the second standing projection 33 enters the second groove portion 25 and is engaged with the first standing projection 45. The lever 40 rotates in a standing direction (in a clockwise direction) around the center hole 41 fitted to the supporting engagement portion 22 (refer to FIGS. 6 and 10).

Figure 7:
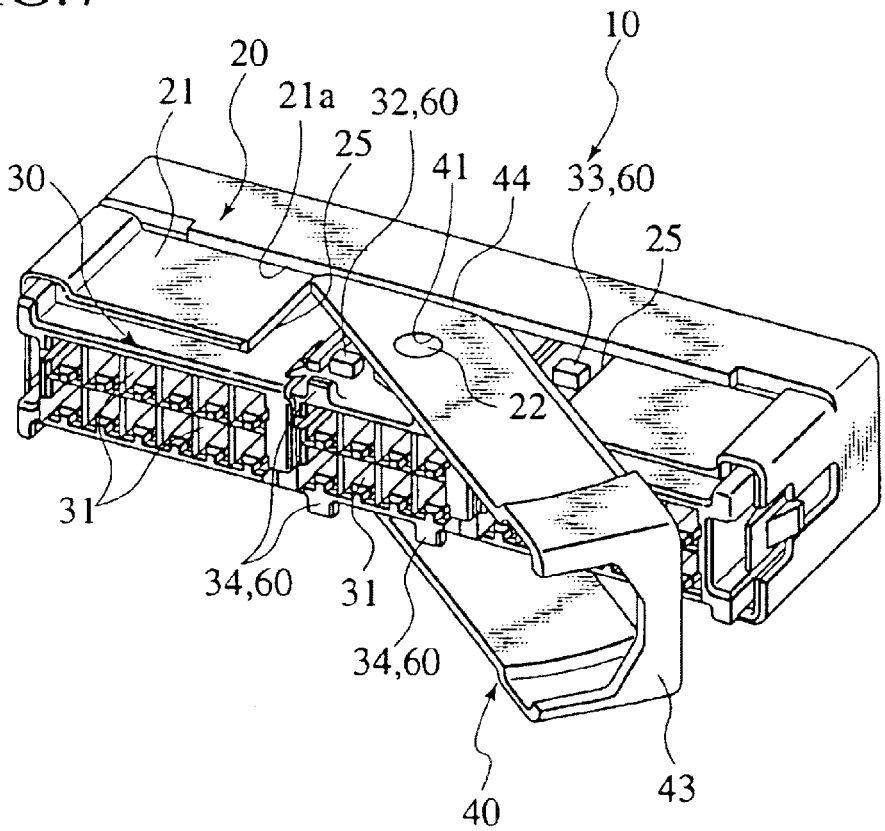
FIG. 7 shows a perspective view of a temporarily fitting state, showing an embodiment of a lever fitting type connector according to the present invention.
Figure 8:
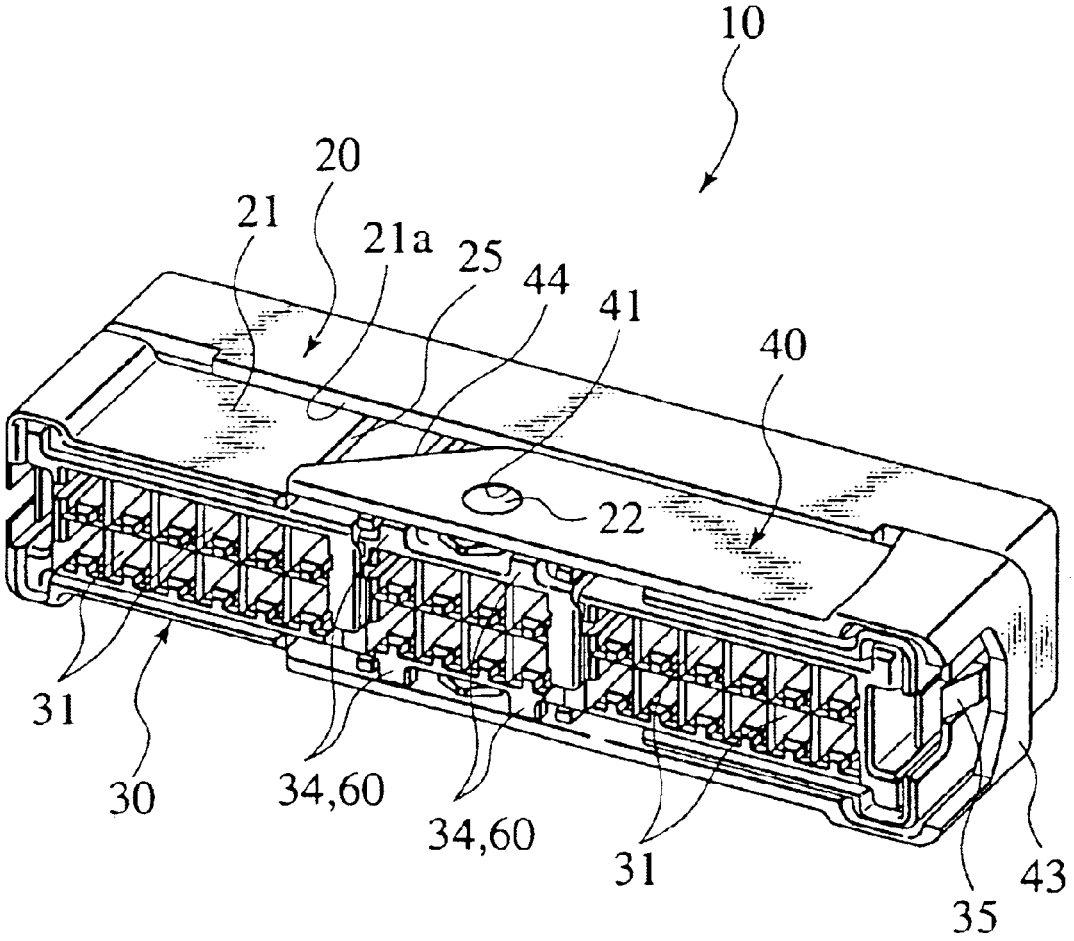
FIG. 8 shows a perspective view of a regularly fitting state, showing an embodiment of a lever fitting type connector according to the present invention.
Figure 12:
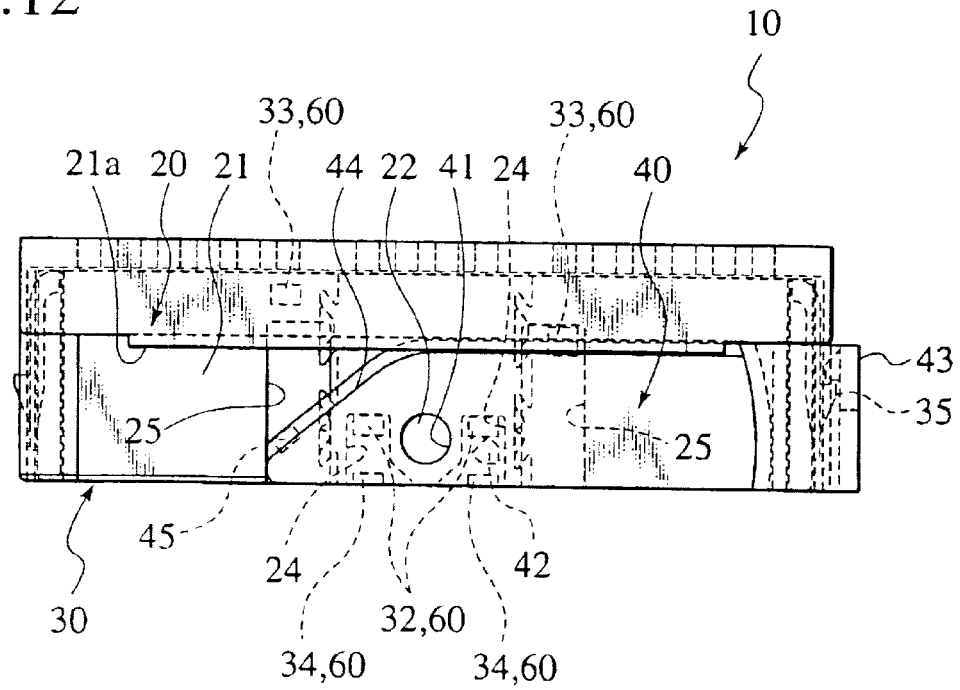
FIG. 12 shows a plan view of a regularly fitting state, showing an embodiment of a lever fitting type connector according to the present invention.

As shown in FIGS. 7 and 11, in a state to which the female and male connectors 20 and 30 are temporarily fitted, the inserting engagement portion 32 enters the first groove portion 24 and the lever 40 are completely stood up. In a state that the lever 40 is completely stood up, the applicating projection 42 is engaged with the inserting engagement portion 32. In this state, applying the operation force in a pressing direction to the operation portion 43 of the lever 40, the lever 40 rotates to a direction of the female connector 20 (in a counterclockwise direction in the drawings) around the supporting engagement portion 22. Accordingly, a fitting force, in which the operation force is servo assisted according to a lever effect, is generated in the inserting engagement portion 32 engaged with the applicating projection 42. Due to the fitting force (small operation force of the lever 40), as shown in FIGS. 8 and 12, it is possible to regularly fit the male connector 30 to the female connector 20. At this time, the lever 40 is pressed, so that it is in parallel to the width direction X of the frontage 20*a* of the female connector 20. The parallel state of the lever 40 is held by engaged with a lock hook 35 provided on a side surface of the male connector 30.

In the lever fitting type connector 10, the removing engagement portion 34 is provided. Whereby, it is possible to easily separate the regularly fitted female connectors 20 and the male connectors 30. That is, as shown in FIG. 8 and FIG. 12, in a state to which the female and male connectors 20 and 30 are regularly fitted, and the lever 40 is in parallel to the width direction X of the female connector 20, the removing engagement portion 34 engages with the applicating projection 42 of the lever 40. In this engagement state, applying the operation force in a drawing direction to the operation portion 43 of the lever 40, the operation force is servo assisted and the fitting removing force is generated at the removing engagement portion 34. Accordingly, it is possible to easily separate the regularly fitted female connectors 20 from the male connector 30 by the small operation force of the lever 40.

In a state that the female and male connectors 20 and 30 of the lever fitting type connector 10 are separated, since the lever 40 is located in parallel to the width direction X of the female connector 20, it is possible to prevent the lever 40 from largely protruding from the female connector 20. Therefore, it is possible to make the female connector 20 and the male connector 30 to which the lever 40 is mounted small. Accordingly, when arranging the wire harness W/H in the vehicle, it is possible to make the passage space for arranging the wire harness small by making the lever fitting type connector 10 compact. In particular, it is also possible to make the passage space, which arranges the wire harness including the male connector 30 that the lever 40 is not provided, compact. Further, it is possible to reduce the passage space for arranging the wire harness W/H connected to the male connector 30. As a result, it becomes easy to execute an operation of arranging the wire harness W/H, and it is easy to secure the space for arranging the wire harness W/H.

The lever 40 stands up for the first time after the female and male connectors 20 and 30 become in the state of being temporarily fitted. That is, is this state, the arrangement of the wire harness W/H is completed. Hence, it is possible to sufficiently obtain an amount of rotation of the lever 40 required for regularly fitting the female connectors 20 to the regularly fitting male connectors 30. Further, it is possible to sufficiently obtain the servo assisting function of the lever 40, so as to securely execute the regular fitting between the female and male connectors 20 and 30. Therefore, when arranging the wire harness W/H, the lever 40 is located in parallel to the width direction of the female connector 20, so that the lever fitting type connector 10 become compact. After arranging the wire harness W/H, the lever 40 stands up due to the temporarily fitting between the female and male connectors 20 and 30, whereby it is possible to sufficiently obtain the required amount of operation and rotation. The lever 40 stands up after the male connector 30 passes above a rotational locus of the lever 40. Therefore, it is possible to sufficiently secure an angle of rotation of the lever 40 required for the regularly fitting between the female and male connector 20 and 30. Accordingly, it is possible to increase the servo assisting effect by a function of the lever 40.

Figure 13B:
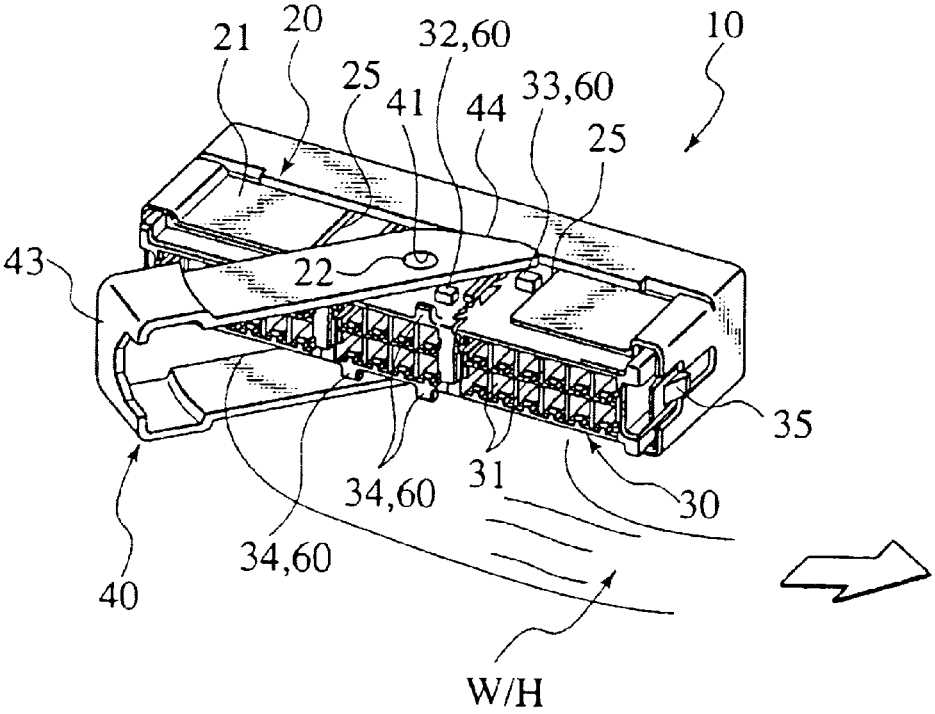

In the lever fitting type connector 10, the center holes 41 of the lever 40 are made detachable from the supporting engagement portion 22. The supporting engagement portion 22 is arranged substantially in the center portion in the width direction X of the female and male connectors 20 and 30. It is possible to reversibly mount the lever 40 on the female and male connectors 20 and 30. The lever 40 is symmetrical in the thickness direction Y of the female and male connectors 20 and 30. The inserting engagement portion 32, the removing engagement portion 34, the engagement portion 60 of the second standing projection 33, and the first groove portions 24 and the second groove portions 25 are respectively formed symmetrically around the supporting engagement portion 22. Since the inserting engagement portion 32, the removing engagement portion 34, the second standing projection 33, the engagement portion 60 of the second standing projection 33, and the first and second groove portions 24 and 25 are respectively formed symmetrically around the supporting engagement portion 22, in accordance that the lever 40 is reversibly mounted, it is possible to reverse them in the width direction X as shown in FIG. 13B from the mounting portion of the lever 40 shown in FIG. 13A. Accordingly, in FIGS. 13A and 13B, there is schematically shown the direction of arranging the wire harness W/H connected to the male connector 30. As shown in FIGS. 13A and 13B, the structure is made such that the mounting direction of the lever 40 can be optionally reversed in correspondence to the direction of taking out the wire harness W/H. Accordingly, it is possible to do away with the restriction in the direction of connecting the wire harness W/H. Further, it is possible to do away with an influence given by the direction of the lever fitting type connector 10 in correspondence to the vehicle requirement, and it is possible to widen a freedom of the wire harness W/H layout.

Figure 14:
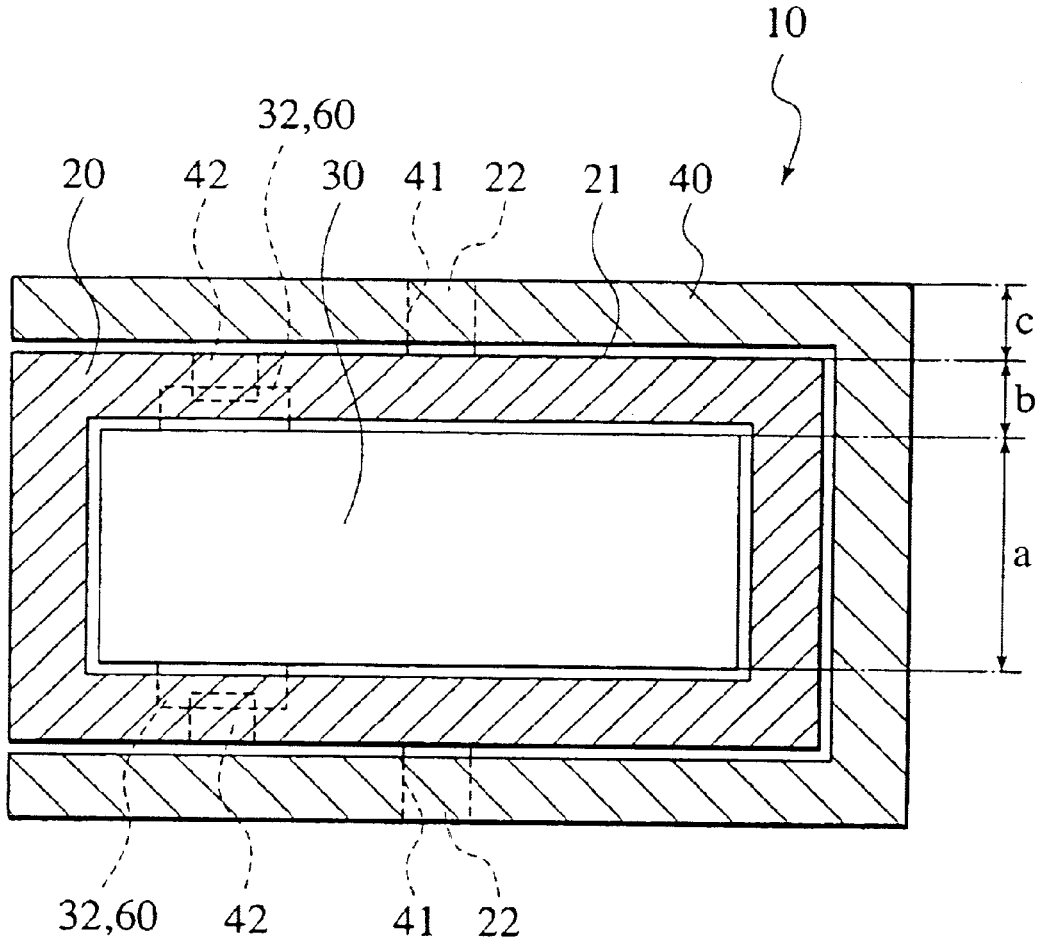
FIG. 14 shows a schematically cross sectional view describing a structure in a thickness direction, showing an embodiment of a lever fitting type connector according to the present invention.

In the lever fitting type connector 10, the lever 40 is arranged in the outer side of the hood portion 21 provided as the step portion 21*a* in the female connector 20 and is formed thin. The inserting engagement portion 32, the second standing projection 33 and the removing engagement portion 34 are protruded outward from the male connector 30. The applicating projection 42 and the first standing projection 45 are protruded inward from the lever 40. The inserting engagement portion 32, the second standing projection 33, the removing engagement portion 34, the applicating projection 42, and the first standing projection 45 are arranged within the first and second groove portions 24 and 25, and are included within a range of the thickness of the female connector 20. Accordingly, in the state of regularly fitting the female and male connectors 20 and 30, the thickness b of the female connector 20 and the thickness c of the lever 40 are only added to the outer side of the male connector 30 having the thickness a, so that there is no case that the protruding part of the engagement portion 60 is included (refer to FIG. 14). Accordingly, it is possible to reduce the thickness of a whole of the lever fitting type connector 10. Therefore, it is possible to make a whole of the female and male connectors 20 and 30 compact. Then, the space for receiving the lever fitting connector 10 becomes small. Further, since the lever 40 is arranged in an outer side of the female connector 30, it is possible to reinforce the female connector 30 by the lever 40.

In the lever fitting type connector 10, the removing engagement portion 34 is constituted to form a pair with the inserting engagement portion 32. As shown in FIGS. 8 and 12, the structure is made such that the removing engagement portion 34 engages with the applicating projection 42 of the lever 40 in the state of regularly fitting the female and male connectors 20 and 30. Hence, it is possible to generate an engagement canceling force between the female and male connectors 20 and 30 by applying the operation force in the drawing direction reverse to the fitting direction, when regularly fitting. It becomes easy to separate the lever fitting type connector 10 that is temporarily connected. Further, the removing engagement portion 34 is constituted to form a pair with the inserting engagement portion 32. Accordingly, even in the case of reversibly changing the direction of mounting the lever 40, it is possible to generate the engagement canceling force in the respective mounting states.

In the present embodiment, there is disclosed the case of initially mounting the lever 40 to the outer side of the female connector 20. However, the structure is not limited to this. By forming the applicating projection 42 and the first standing projection 45 at the reverse positions with respect to the center hole 41 of the lever 40, it is possible to initially mount the lever 40 on the male connector 30. In this case, the supporting engagement portion 22 is formed in the male connector 30. Further, the engagement portion 60 constituted by the inserting engagement portion 32, the second standing projection 33, the removing engagement portion 34 and the like are formed in the female connector 20 in correspondence to the applicating projection 42 and the first standing projection 45.

What is claimed is:

1. A lever fitting type connector comprising:

a first connector;

a second connector fitted to the first connector;

a lever interposed between the first connector and the second connector, and converting an operation force applied to an operation portion into a fitting force between the first connector and the second connector, wherein the lever is rotatably pivoted on the first connector, and an engagement portion engaging with the lever is provided on the second connector; and a standing mechanism provided between the lever and the second connector, and the standing mechanism standing the lever when temporarily fitting the first connector to the second connector, wherein the first connector and the second connector are regularly fixed to each other by applying an operation force to the operation portion in a standing state of the lever.

wherein the lever is rotatably pivoted about a supporting engagement portion on the first connector, and the engagement portions are disposed substantially symmetrically about the supporting engagement portion.

2. The lever fitting type connector of claim 1, wherein the standing mechanism comprises:

a first engagement portion provided on the lever; and a second engagement portion provided on the second connector and engaged with the first engagement portion.

3. The lever fitting type connector of claim 1, wherein the lever rotates and stands up about a pivot portion.

4. The lever fitting type connector of claim 1, further comprising a groove portion formed on the first connector configured to accommodate at least one of the plurality of engagement portions;

wherein the groove portion is disposed substantially symmetrically about the supporting engagement portion.

5. The lever fitting type connector of claim 1, wherein the engagement portion is thinner than the first connector.

6. The lever fitting type connector of claim 1, wherein prior to temporarily fitting of the first connector to the second connector the standing mechanism does not stand the lever, and after temporarily fitting of the first connector to the second connector the standing mechanism also does not stand the lever.

7. The lever fitting type connector of claim 1, wherein the lever is rotatably pivoted on a central portion of the first connector.

8. The lever fitting type connector of claim 1, wherein the first connector is configured such that the lever may be reversibly mounted on the first connector.

9. The lever fitting type connector of claim 2, wherein the standing mechanism is configured such that when the first connector is fitted to the second connector, the first connector engages the second engagement portion.

10. A lever fitting type connector comprising:

a first connector having a hood portion;

a second connector fitted within the hood portion of the first connector; and a lever interposed between the first connector and the second connector, the lever configured to convert an operation force applied to an operation portion into a fitting force between the first connector and the second connector, wherein the lever is outward fitted to the hood portion and detachably pivoted on a supporting engagement portion of the first connector, a plurality of engagement portions provided in the second connector are engaged with the lever, and a groove portion formed in the hood portion accommodates at least one of the plurality of engagement portions, and wherein the engagement portions and the groove portion are disposed substantially symmetrically about the supporting engagement portion.

11. The lever fitting type connector of claim 10, wherein the engagement portion is thinner than the first connector.

12. The lever fitting type connector of claim 10, wherein the first connector is configured such that the lever may be reversibly fitted to the first connector.

13. The lever fitting type connector of claim 10, wherein the substantially symmetrical disposition of the engagement portions and the groove portion about the supporting engagement portion allows the lever to be reversibly fitted to the supporting engagement portion.

14. A lever fitting type connector comprising:

a first connector having a hood portion;

a second connector fitted within the hood portion of the first connector; and a lever interposed between the first connector and the second connector, the lever converting an operation force applied to an operation portion into a fitting force between the first connector and the second connector;

wherein the lever is outwardly fitted to and detachably pivoted on a supporting engagement portion on the first connector, a plurality of engagement portions are provided in the second connector, and the engagement portions are disposed substantially symmetrically about the supporting engagement portion.

15. The lever fitting type connector of claim 14, wherein the engagement portion is thinner than the first connector.

16. The lever fitting type connector of claim 14, wherein the first connector is configured such that the lever may be reversibly fitted to the first connector.

17. The lever fitting type connector of claim 14, wherein the substantially symmetrical disposition of the engagement portions about the supporting engagement portion allows the lever to be reversibly fitted to the supporting engagement portion.

* * * * *

UNITED STATES PATENT AND TRADEMARK OFFICE

CERTIFICATE OF CORRECTION

PATENT NO. : 6,796,815 B2
DATED : September 28, 2004
INVENTOR(S) : Toshiaki Okabe et al.

It is certified that error appears in the above-identified patent and that said Letters Patent is hereby corrected as shown below:

Column 10,
Line 57, “lever.” should read -- lever, --.

Column 11,
Line 37, after “fitted”, delete “to the hood portion”.

Signed and Sealed this

Twenty-third Day of August, 2005

JON W. DUDAS
*Director of the United States Patent and Trademark Office*